US005733234A

United States Patent [19]

Greiner et al.

[11] Patent Number: 5,733,234

[45] Date of Patent: *Mar. 31, 1998

[54] METHOD AND APPARATUS FOR PRODUCING FIBER SKEINS

[75] Inventors: Christoph Greiner, Vörstetten; Thomas Leutner, Herbolzheim; Eberhard Teufel, Gundelfingen, all of Germany

[73] Assignee: Rhone-Poulenc Rhodia Aktiengesellschaft, Freiburg, Germany

[ * ] Notice: The term of this patent shall not extend beyond the expiration date of Pat. No. 5,460,590.

[21] Appl. No.: 496,570

[22] Filed: Jun. 29, 1995

Related U.S. Application Data

[63] Continuation-in-part of Ser. No. 92,322, Jul. 14, 1993, Pat. No. 5,460,590.

[51] Int. Cl.[6] ..... B65H 59/14; B65H 59/16

[52] U.S. Cl. ..... 493/4; 83/856; 493/39

[58] Field of Search ..... 493/4, 37, 39, 493/40, 42, 44, 45, 49, 50; 83/856, 858

[56] References Cited

U.S. PATENT DOCUMENTS 4,507,107 3/1985 Berger ..... 493/44

5,460,590 10/1995 Greiner et al. ..... 493/4

*Primary Examiner*—Jack W. Lavinder

*Assistant Examiner*—Anthony Ojini

*Attorney, Agent, or Firm*—Bucknam and Archer

[57] ABSTRACT

A method of producing at least one filter skein for cigarettes and other smokable rod-shaped articles, from at least one filter tow strip comprises the steps of: (a) drawing at least one filter tow strip, from at least one supply, (b) feeding the at least one filter tow strip to a treatment in a treatment unit; (b1) at the beginning of the treatment unit, subjecting at least one filter strip to a brake force to adjust at least the quantity to be processed, the brake force being set automatically, and (b2) afterwards, stretching and fluffing the filter tow strip(s) by the use of two pairs of rolls, wherein the surface of one roll of at least one pair of the two pairs is smooth and the other roll is profiled over its entire surface, (c) after the treatment, collecting the treated filter tow strip from step (b) in a formating unit to at least one round skein with an enveloping material to form at least one continuous, wrapped filter skein, (d) detecting and measuring a characteristic value of the produced filter skein from step c), to obtain an actual value of the characteristic value, and (e) controlling and regulating the brake force as a function of the obtained actual value from step (d) and of a predetermined desired value of the characteristic value at the beginning of the treatment in step (b1), prior to the stretching step (b2), the brake force acting on the at least one filter tow strip. The apparatus is described.

27 Claims, 10 Drawing Sheets

METHOD AND APPARATUS FOR PRODUCING FIBER SKEINS

This application is a Continuation-in-Part of U.S. Ser. No. 08/092,322, now U.S. Pat. No. 5,460,590 filed Jul. 14, 1993.

FIELD OF THE INVENTION

The present invention relates to a method for producing a fiber skein or several wrapped fiber skeins, in particular for making filter skeins for cigarettes and other smokable, rod-shaped articles, and an apparatus for carrying out the method.

BACKGROUND OF THE INVENTION

In the mass production of cigarettes and other such smoking articles, filters are used which are made from a band of cellulose acetate fibers or other suitable materials. This band, the so-called filter tow strip, is drawn off a supply bale, treated for further processing, and then collected in a formating unit to a round fiber skein and provided with a wrapping material, e.g. a paper strip. This filter skein is finally cut into single filter rods.

A known method for producing filter rods for cigarettes and an apparatus suitable for carrying out this method are described in DE 41 09 603 A1. The known apparatus consists essentially of a treatment unit, in which a supplied filter tow strip is subjected, inter alia, to stretching and fluffing, an auxiliary unit for applying an additional filter material component on the treated filter tow strip, a formating unit for forming a filter skein by collecting and wrapping the treated filter tow strip with a wrapping material, and a cutting unit for successive severing of filter rods from the filter skein. With the known apparatus a single filter skein is produced.

In the treatment unit of the known apparatus a pair of driven brake rolls is provided, which draws the filter tow strip off a filter tow bale. According to the state of the art there are known also treatment sections which use at the inlet of the treatment section a pair of non-driven brake rolls. Such a treatment section is for example a commercial AF2 of Körber AG, Hamburg. The treatment section described in DE 41 09 603 A1 with a pair of driven brake rolls has the following disadvantages: The further the filter tow strip is drawn off from the bale, the longer will be the piece of filter tow strip between the bale and the drawing pair of rolls, owing to which the weight of the piece of filter tow strip between the bale surface and the drawing pair of rolls increases and hence the filter tow strip is stretched. In addition, with increasing drag length of the filter tow strip at high drawing speeds, the air friction acting on the filter tow strip becomes greater and greater, which also leads to a pre-stretching of the filter tow strip. This stretching has the results, however, that less and less weight of the filter tow strip per unit of time or per unit of length is fed to the drawing pair of rolls, that is, the fed quantity of filter tow strip varies at constant speed of the pair of driven brake rolls. This has an adverse effect on the produced filter skein, as its density also changes when the supplied amount of filter tow strip changes. If too little filter tow strip is supplied, the density or mass of the produced filter rods or filter skein will be insufficient so that the produced filter skeins or rods are unusable and constitute scrap. A pair of non-driven brake rolls or a pair of "dragged" brake rolls partly compensates this disadvantage and further fluctuations deriving from the filter skein, e.g. crimp index fluctuations, which would affect the quality of the filter skeins in the cited treatment section AF 2, depending on the specification of the filter tow strip in processing, a brake force to be set at a constant value is applied on the pair of dragged brake rolls. This is evident from the brochure "Technische information 2-01" the "Kabelkennlinie" (Cable Characteristic) of Rhodia AG, Edition January 1989. Control of the mass in the filter skein is obtained according to the state of the art by changing the speed of the treatment unit in relation to the speed of the formating unit.

In the U.S. Pat. No. 3,399,606 granted to D. W. Molins an apparatus for manufacturing of filter plugs is described. Molins describes a first pair of driven rolls and a second pair of driven rolls being arranged after the first pair of driven rolls. The second pair of driven rolls is driven at constant speed but the first pair of driven rolls are driven at a lower and controlled variable speed so that the tow is stretched between the two pairs of driven rolls at a variable controlled extent. Prior to being subjected to the action of the two pairs of driven rolls, the fibers of the tow are opened or fluffed out.

It should be stressed that Molins describes a single stage stretching unit which is regulated by means of gears. Since the gears have a large inertia, with such a stretching unit one can only regulate variations related to the tow within very narrow limits. In view of the fact that according to Molins every regulating action is carried out in the region of stretching, the quality of tow treatment, blooming, filament separation, etc. is altered so that the tow treatment results in additional dust, in the case of high tow stretching and in higher consumption of material in the case of lower tow stretching.

It is also significant that with the apparatus and process of Molins, every change of the degree of stretching affects the width of the tow in the region of the plasticizer application so that the amount of plasticizer is changed in this region. In order to correct this effect, one should change the speed relations between the pair of stretching rolls and the pair of supply rolls being arranged afterwards. Due to these reasons, single stage stretching units as in Molins are operated in accordance with the state of the art so that only one defined stretching relation is used.

In the U.S. Pat. No. 5,106,357 invented by W. Kampen a method and an apparatus for producing tobacco smoke filter rods are described. In the discussion of the prior art, Kampen stresses the disadvantage resulting from the use of an apparatus in which the filter tow is drawn off continuously from the surface of the bale, spread out (nozzle), passed over a roll or similar guide member, and then spread out again (nozzle). It is guided through a pair of braking rolls, stretched, a second pair of stretching rolls, relaxed, spread out again, sprayed with plasticizer, guided over deflection rollers and through an intake nozzle and then through an intake funnel and an intake finger. Kampen states that the effect of stretching the filter tow is that the crimped spun fibers and/or filaments separate from each other. Subsequently the filter tow is relaxed, and contracts with fluffing, because of its crimping elasticity. One disadvantage according to conventional methods according to Kampen is that with increasing intake nozzle pressure and increased quantity of filter tow in the intake funnel, the uniform distribution of the mass of filter tow in the finished tobacco smoke filter rods deteriorates because the mass becomes heterogeneous. The result of this is that the drawing resistance becomes non-uniform over the length of these filter rods and from rod to rod. Besides, Kampen is based on the known above mentioned treatment section AF2 which is used at present commonly. The AF2 comprises: a pair of non-driven brake rolls; two pairs of driven stretching rolls, one of the rolls of each pair being profiled and the other one of the rolls of each pair being smooth; a spraying device for spraying the filter tow with a plasticiser; and a pair of deflection rolls to supply the filter tow in the formating unit.

Clearly two stage stretching units are described by Kampen (and also in U.S. Pat. No. 4,511,420 by Arthur) in the discussion of the prior art. In the two stage stretching unit, comprising three pairs of rolls, two of which are driven and one of which is non-driven, the two pairs of driven rolls provide the stretching zone and the pair of non-driven rolls provides together with the first pair of driven rolls the pre-tension zone. The speed relations of the pair of driven rolls and the constant pressure of the pair of non-driven rolls are maintained. Further, the control of the amount of material in the produced filter rod is provided, in the same manner as with the single stage stretching unit, by changing the supply degree between the stretching means and the filter skein formating unit. However, Kampen is totally silent with respect to how short term variations of the filter tow in mass per unit length could be eliminated.

The U.S. Pat. No. 3,960,645 describes a method and an apparatus for the opening of tow which have been invented by W. A. Brackmann et al. In the summary of the prior art, Brackmann discusses the disadvantage resulting from the known methods of opening the tow, namely the tow is subjected to a differential gripping action between a plurality of points spaced from one another transversely of the path so that certain laterally-spaced sections of the tow are positively gripped relative to other laterally-spaced sections of the tow. This differential gripping action has been accomplished by a pair of rolls, one of which is smooth surfaced and the other is grooved over its entire periphery. The tow is maintained under tension upstream of the differential gripping action so that after release of the tension on the downstream side of the differential gripping action, the tow is fluffed. The result has been that the density of the tow varies over a wide range and the resistance which filter rod sections offer to the passage of cigarette smoke varies, rendering inconsistent the draw characteristics of cigarettes to which filter tips formed from such filter rod sections are applied.

Brackmann's invention resides in maintaining uniform tension on the tow. The strand of tow material is drawn upwardly to an idler roll before passing inclinedly downwardly to the nip of a pair of drag rolls. During passage from a bale to the idler roll, the tow passes a first nozzle connected to a source of compressed air and situated opposite a plate. The first pair of rolls includes an upper roll and a lower roll. Brackmann states that the pressure in the nip between the rolls of the pair of first rolls, is sufficient to provide a friction grip on the tow in the nip but insufficient to provide any braking action.

SUMMARY OF THE INVENTION

It is the object of the present invention to provide a method and an apparatus for producing a fiber skein or several fiber skeins which permit higher productivity at equally good quality of the produced fiber skeins or filter skeins. In particular, the quantity of fiber strip or filter tow processed in the treatment unit of the apparatus is to be kept constant to the extent possible.

According to the invention, the solution of this problem consists in a method of producing at least one filter skein for cigarettes and other smokable rod-shaped articles, from at least one filter tow strip which comprises the steps of:

(a) drawing said at least one filter tow strip, from at least one supply, (b) feeding said at least one filter tow strip to a treatment in a treatment unit;, (b1) at the beginning of said treatment unit, subjecting said at least one filter tow strip to a brake force to adjust at least the quantity to be processed, the brake force being set automatically, and (b2) afterwards, stretching and fluffing of said filter tow strip(s) by the use of two pairs of rolls, wherein the surface of one roll of at least one pair of said two pairs of rolls is smooth and the other roll is profiled over its entire surface, (c) after said treatment, collecting said treated filter tow strip from step (b) in a formating unit to at least one round filter skein and providing said at least one round filter skein with an enveloping material to form at least one continuous, wrapped filter skein, (d) detecting and measuring a characteristic value of said produced filter skein from step (c), to obtain an actual value of said characteristic value, and (e) controlling and regulating said brake force as a function of said obtained actual value from step (d) and of a predetermined desired value of said characteristic value at the beginning of said treatment in step (b1), prior to said stretching step (b2), the brake force acting on said at least one filter tow strip.

Further, according to the invention, a component part of the solution of the above problem is an apparatus for producing at least one filter skein for cigarettes and for other smokable rod-shaped articles, from at least one filter tow strip which comprises:

(a) feeding means for continuous feeding at least one filter tow strip to a treatment unit, (b) said treatment unit having an inlet side and comprising, (b1) a brake unit arranged on said inlet side in said treatment unit, said brake unit exerting a brake force on said at least one filter tow strip, to adjust the quantity to be processed of said at least one filter tow strip to a predetermined value, (b2) stretching means arranged downstream of said brake unit providing stretching of said at least one filter tow strip, and, (b3) fluffing means arranged downstream of said stretching means providing fluffing of said at least one stretched filter tow strip, wherein the stretching and fluffing means comprise two pairs of rolls, wherein the surface of one roll of at least one pair of said two pairs of rolls is smooth and the other roll is profiled over its entire surface, (c) a formating unit for forming at least one filter skein from at least one filter tow strip, treated in treatment unit (b), (d) a measuring device for detecting and measuring at least one characteristic value of said at least one filter skein, to provide respective measurement signals which are assigned to an actual value of the characteristic value, (e) means for providing said actual value of the characteristic value from said measurement signals, for comparing said actual value with a predetermined desired value and for providing an electrical control signal, and (f) a setting device for controlling said brake unit depending on said electrical signal from said means (e), to control or regulate automatically said quantity of said at least one filter tow strip, to be processed by means of said exerted brake force.

Accordingly, in the method of the invention for producing at least one fiber skein, in particular for producing at least one filter skein for the production of filters for cigarettes and other smokable rod-shaped articles, at least one fiber strip, in particular a filter tow strip, is dram off from a supply and subjected to a further treatment in which the fiber strip or strips are, inter alia, stretched and fluffed. In treating the supplied filter tow strip or strips, they are first subjected to a brake force. This force is automatically controllable and sees to it that the length-related mass of the formed fiber skeins remains constant.

Due to the brake force exerted e.g. on a fiber strip, certain properties of the fiber strip can be compensated, which in turn affect the properties of the fiber skein. Such properties of the fiber strip are e.g. the crimp index and the total titer (the total denier).

The brake force on the fiber strip can be controlled manually. Preferably it is controlled automatically through a respective control system.

To permit automatic control of the brake force on the fiber strips, there is picked up and measured e.g. a characteristic value of the produced filter skeins. The quantity to be processed of the supplied fiber strip is then set as a function of the measured instantaneous value or actual value and of predetermined values, as e.g. a desired value for the respective measured characteristic value, by regulating the brake force on the fiber strip or strips.

Picking up and measuring a characteristic value of the produced filter skein or skeins or fiber skeins means in the context of the present invention that this measuring can be done both on endless filter skeins or fiber skeins as well as on finite filter rods.

It should be noted that according to the present invention, the brake roll pressure may be regulated within large limits without the negative effects concerning quality of treatment, that is, dust, larger consumption of material or the regularity of the plasticizer deposition.

According to the present invention in the stretching and fluffing means two pairs of rolls are used wherein the surface of one roll of at least one pair of said two pairs of rolls is smooth and the other roll is profiled over its entire surface. This profiling of the roll(s) reduces significantly the production of fly dust, at least in a quite large range, during filter rod making, as shown by the dotted line in FIG. 9, where the production of fly dust shows only a slight increase with increasing pretension pressure caused by the brake force of the brake unit or the pair of non-driven rolls of the invention within a quite large usable range.

Additionally, FIG. 9 shows by the solid line that the yield (deviation from optimum weight) of the produced filter skein(s) or rods can be maintained in a large usable range, which means by using the automatic control of the braking force (pretension pressure) according to the invention not only long term variations of the mass at an optimum yield of the produced filter skein(s) but also short term variations of the mass at an optimum yield can be eliminated to achieve an optimum predetermined yield or mass per length within a quite large usable range of operation.

Moreover FIG. 9 shows that the usable range with respect of reduction of fly dust and the usable range with respect of optimum control of filter rod are substantially the same (for instance, between 1 and 2.5 bar of pretension pressure as shown in FIG. 9), which means that the present invention combines the advantage of control of the mass at an optimum yield together with the advantage of reduced and permitted fly dust in a large usable range. Consequently, the present invention is superior over the prior art methods with respect to quality of produced filter rods.

In order to stress the advantage of the present invention, FIG. 10 shows the conditions given in the prior art, for instance, according to Molins comprising pairs of driven rolls with smooth rolls only and a constant pretension pressure of the pair of non-driven rolls arranged before the pairs of driven rolls. According to the prior art controlling the difference of speed of the pairs of driven rolls helps only to maintain optimum yield in a small usable range in comparison to the large usable range of the invention. In the prior art, therefore, variations of the weight or mass per length of produced filter rods can be eliminated only in a small range of variations of long term (refer to the solid line of FIG. 10). Further, since the rolls of the pairs of driven rolls of the prior art have only a smooth surface, the fly dust production of the prior art increases steeply with increasing speed of the pairs of driven rolls as shown in FIG. 10 by the dotted line. Consequently, the method and apparatus of prior art show only a small usable range of operation. With the method and apparatus of the invention, several fiber skeins, e.g. fiber strips drawn off from a bale or from several bales, can be produced simultaneously. Preferably at least one characteristic value for each of the simultaneously produced fiber skeins is measured, and from the measurement results and predetermined desired values a mean value is determined for the brake force. This mean brake force then acts on all fiber strips sent to the treatment.

Alternatively, the feed quantity for each of the fiber strips can be set individually through a correlated brake force. For this purpose there can be used for each drawn-off fiber strip, before it reaches the pair of drawing rolls in the treatment unit, a pressure-controlled pair of brake rolls through which the respective fiber strip passes.

With the method and apparatus according to the invention also a single filter skein can be produced from a single drawn-off fiber strip, a characteristic value, e.g. the density and hence the mass per length of the produced filter skein being measured and the quantity to be processed of the fiber strip being controlled and regulated as a function of the measurement result and of additional preset values via the brake force on the fiber strip.

As brake system for applying the brake force on the fiber strip, generally a pair of brake rolls or several such pairs can be used, through which a fiber strip runs in each instance. The rolls of these pairs of brake rolls are, as has been mentioned before, themselves not driven. There is provided a respective controllable setting device, which operates e.g. pneumatically, hydraulically or in another suitable manner and presses one of the brake rolls with a corresponding force toward the other roll of the pair of brake rolls to exert a brake force on the fiber strips running through the pair of brake rolls. The brake system may have e.g. two pairs of brake rolls if two fiber strips are to be treated in the treatment unit simultaneously, from which two fiber skeins are then to be produced by the subsequent processing steps. The two pairs of brake rolls may be "coupled", i.e. while there are two separate pairs of brake rolls, these pairs are actuated simultaneously by one and the same setting device. Thus the pairs of brake rolls produce identical brake forces on the fiber strips running through them. As brake device may be used also at least one brake rod over which the fiber strips are guided, at least one of the brake rods being movable, to make the relative position of the brake rods variable, to be able to set the brake force on the fiber strips.

Alternatively, the brake system may have at least one brake plate over which the fiber strips are guided, the brake plate being movable to be able to set or to vary the brake force on the fiber strips.

By adjustment of the feed quantity and/or other properties of the fiber strips, a uniform quality of the produced filter skeins can be obtained even if the supplied fiber strips have relatively great deviations from the desired set values. In particular if within the fiber strip of a bale there are i.a. fluctuations of the crimp index and/or the total titer, they can be compensated via the automatic control of the brake force without requiring manual resetting of the machine by the personnel. Lastly, by adjustment of the feed quantity of fiber strips to further processing, the scrap rate can be reduced, thus increasing the productivity of the filter skein production.

Increased productivity in the manufacture of fiber skeins can be achieved quite generally also by making several fiber skeins simultaneously, the simultaneously produced fiber skeins being produced from at least one continuously fed fiber strip and at least one characteristic value of the produced fiber skeins being measured and the feed quantity of fiber strip or strips being automatically controlled as a function of the measurement result.

With the method according to the invention several wrapped fiber skeins can be produced simultaneously from at least one continuously fed fiber strip. The quality of the fiber skeins is monitored by detecting and evaluating a characteristic value of the fiber skeins in order to set the feed quantity of fiber strip or strips by control of the brake force, so as to ensure e.g. uniform density or mass of the finished fiber skeins. The apparatus according to the invention has for the simultaneous production of several wrapped fiber skeins a treatment unit which guides at least one fiber strip, specifically a filter tow strip, to a formating unit which forms the supplied fiber strips, which are wrapped with enveloping material. With this apparatus, which can produce e.g. simultaneously two fiber skeins, the productivity of the fiber skein manufacture can be doubled without requiring more personnel or more space for accommodating this double skein machine.

The apparatus according to the invention comprises a measuring device with which important properties and values of the fiber skeins or filter rods can be monitored during production. Such properties and quality parameters for fiber skeins or filter rods are e.g. their density or mass, their draw resistance and diameter. As starting material of multi-skein production e.g. two fiber strips running side by side can be supplied simultaneously to a double skein machine or double skein filter rod machine. In this case the treatment unit sees to it that the feed quantity is controllable singly for each of the two fiber skeins. Preferably there may be used to this end individually controllable pairs of brake rolls, through which runs in each instance one of the fiber strips in the treatment unit to set the feed quantity for the further treatment automatically. By the brake force exerted by the pair of rolls on the fiber strip the feed quantity can be varied within certain limits, to be able to stay within the filter tolerances to be achieved. The pair of brake rolls consists of a rubber-coated roll and a steel roll. The braking of the fiber strip occurs by the flexing work of the rubber-coated roll on the steel roll, the fiber strip driving the rolls. If, however, the two separately drawn-off fiber strips have individually greatly different properties, as e.g. a greatly different total titer or crimp index, it may become difficult to compensate the differences between the fiber strips with the individually controllable pairs of brake rolls. The result would be that the simultaneously produced fiber skeins differ in their properties and at worst the desired tolerances would be exceeded. For this reason, in filter rod production, preferably a multiple-width filter tow strip is used which has a predetermined tear line to make it divisible.

Preferably a double-width fiber strip is used which is parted at its central predetermined tear line into two single-width fiber strips in the treatment unit. The separated single-width fiber strips or respectively the two strip halves of the wide fiber strip drawn off a bale, advantageously have essentially the same material properties, in particular the same quantity or mass per length, so that overly great differences in the important material properties are reliably avoided and thus the tolerances of the fiber skeins in double fiber skein production can be met reliably.

The preferred double-width divisible fiber strip is therefore characterized by the fact that all quality-relevant parameters for the fiber skein production can, by reason of its production, differ only insignificantly in the two fiber strip halves, as both halves of the double-width fiber strip are produced in the same operation.

The use of a double-width fiber strip drawn from a single bale has advantages in particular when the double-width fiber strip has been completely drawn off, i.e. the bale must be changed. With the double-width fiber strip then only one bale need be replaced and threaded into the double-skein machine to be able to continue the operation. This also constitutes an improvement over the alternative embodiment of the present invention where two separate fiber strips are drawn off from a bale for each. In that case the bales basically do not expire simultaneously, so that in principle two machine stops are necessary, resulting in greater cost of personnel and more scrap. This is avoided when using the double-width fiber strip with one bale.

The precise construction of the double-width, divisible fiber strip used and of additional multi-width and asymmetrical fiber strips described in the co-pending application "Multi-width fiber strips and a method and apparatus for its production", originating from the same applicant as the present application, and to which reference is here made expressly.

To achieve fast quantity control with the brake system, continuous monitoring e.g. of the density or mass or of the draw resistance of the fiber skeins or filter rods is of advantage. Suitable for this is a comparative skein density measurement or an on-line draw resistance measurement.

Another advantageous development of the invention consists in that as characteristic value of the produced fiber skeins their mass is detected and determined. Depending on the mass values measured, the feed quantity can be set via the brake force on the drawn-off fiber strips.

In an advantageous variant of the invention, the draw resistance of the filter rods is determined as characteristic value of the fiber skeins produced. As a function of the draw resistance found, the feed quantity of fiber strip is regulated with the brake system in the treatment unit in the sense stabilizing the draw resistance.

The characteristic values mass and/or draw resistance of the fiber skeins or filter skeins produced are preferably picked up on-line on the apparatus according to the invention. By the invention the determining properties of the fiber skeins can be optimized and durably maintained in the production. By the adjustment or control of the quantity via the measurement of the characteristic value, as e.g. the draw resistance, it is then ensured that the draw behaviour of the cigarettes is not impaired when smoking through the filter.

A further important advantage of the present invention resides in the fact that it may be used with double skein filter rod machines without substantial amendments of the construction of the treatment unit.

Additional advantages and possibilities of use of the present invention can be seen from the following description of an embodiment given as an example of the invention in conjunction with the drawings.

A BRIEF DESCRIPTION OF THE DRAWINGS

Figure 1:
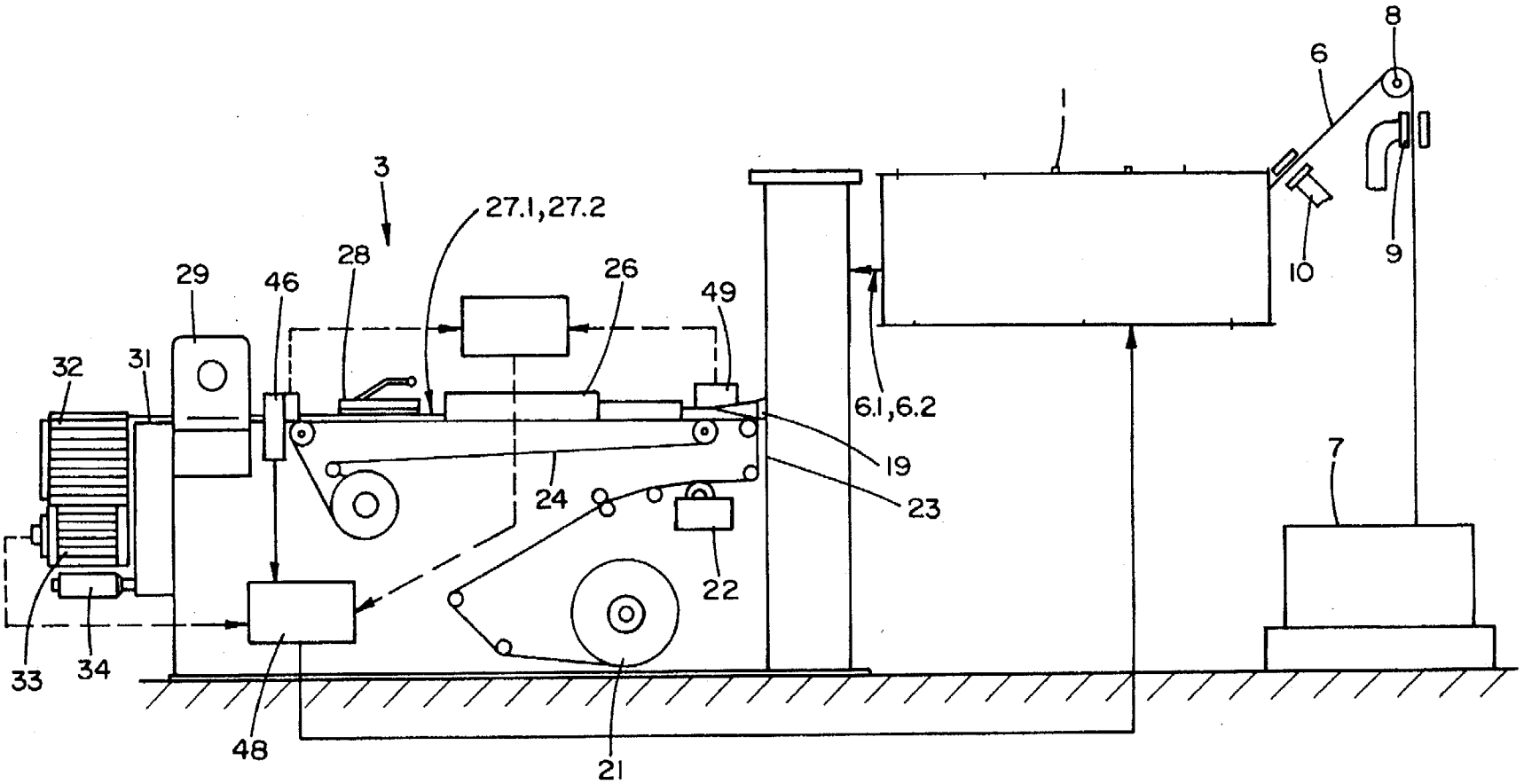
FIG. 1 shows schematically an embodiment of the apparatus according to the invention for carrying out the method of the invention, the apparatus being designed as double filter skein machine.
Figure 10:
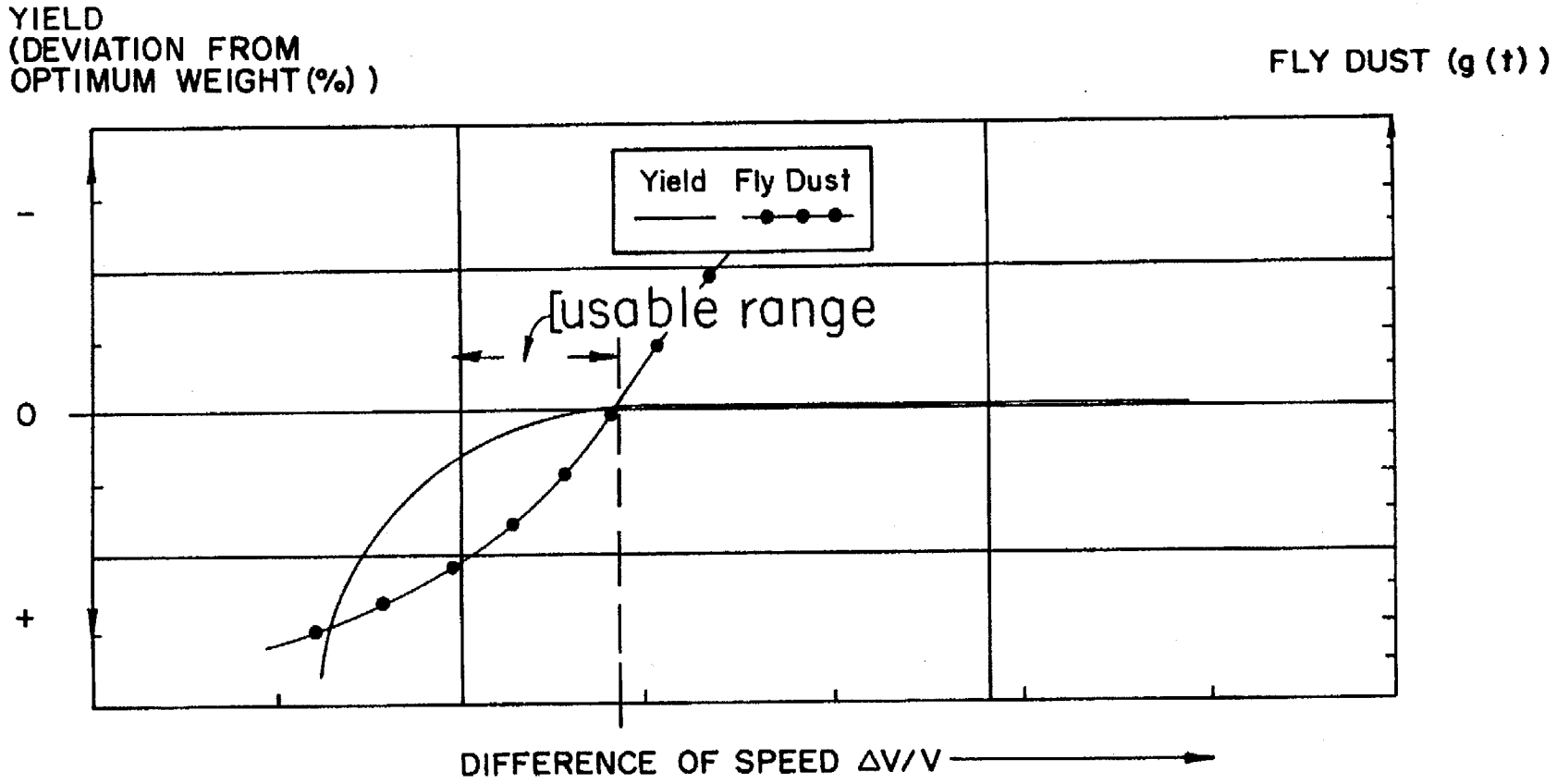
Figure 11A:
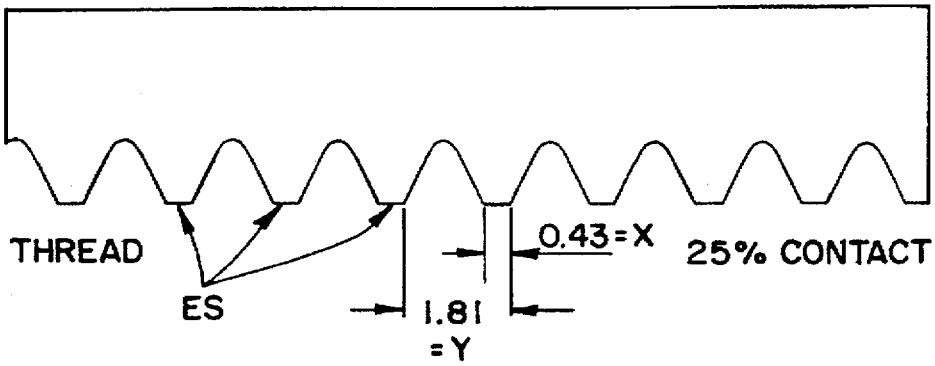
Figure 11B:
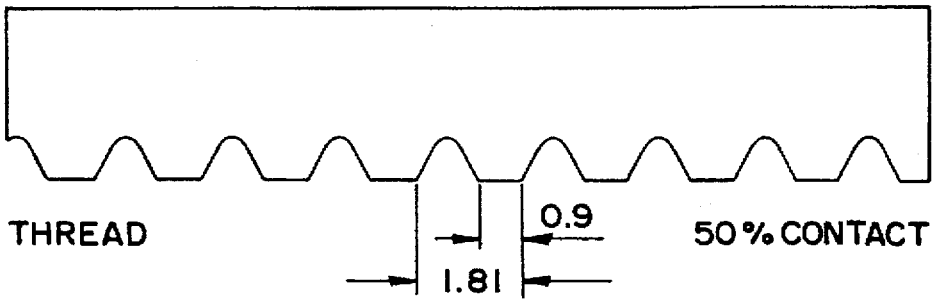
Figure 11C:
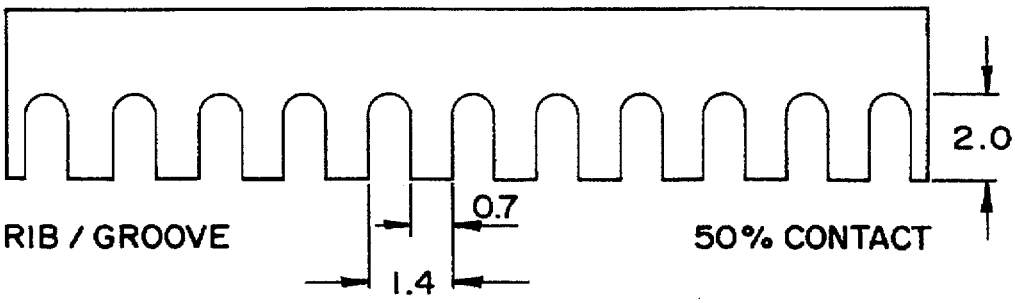
Figure 11D:
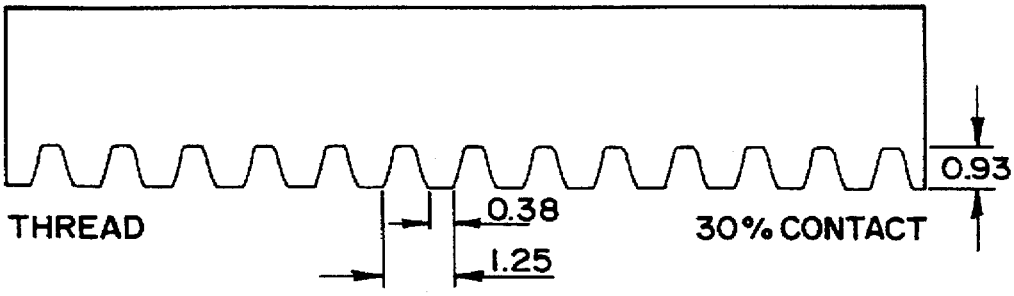

FIG. 10 is a diagram showing the relation of yield and the relation of fly dust via the difference of speed $\Delta v/v$ of the driven rolls in the case of prior art in accordance to Molins (see FIG. 1—$(v_{12}-v_{11})/v_{12}$)); and FIG. 11 comprises schematic cross views (a), (b), (c) and (d) of different possible profiles of the driven rolls according to the embodiment of FIG. 1 of the invention.

In FIG. 1, an apparatus according to the invention as double filter skein machine for simultaneously producing two filter skeins, in particular for the production of filters for cigarettes and comparable smokable articles, is represented in a schematic side view.

The apparatus according to the invention comprises essentially an arrangement 8, 9, 10, through which a double-width divisible filter tow strip is supplied to a treatment unit 1. Unit 1 is followed by a formating unit 3 for simultaneously producing two wrapped filter skeins from the dram-off and treated filter tow strip.

Figure 3:
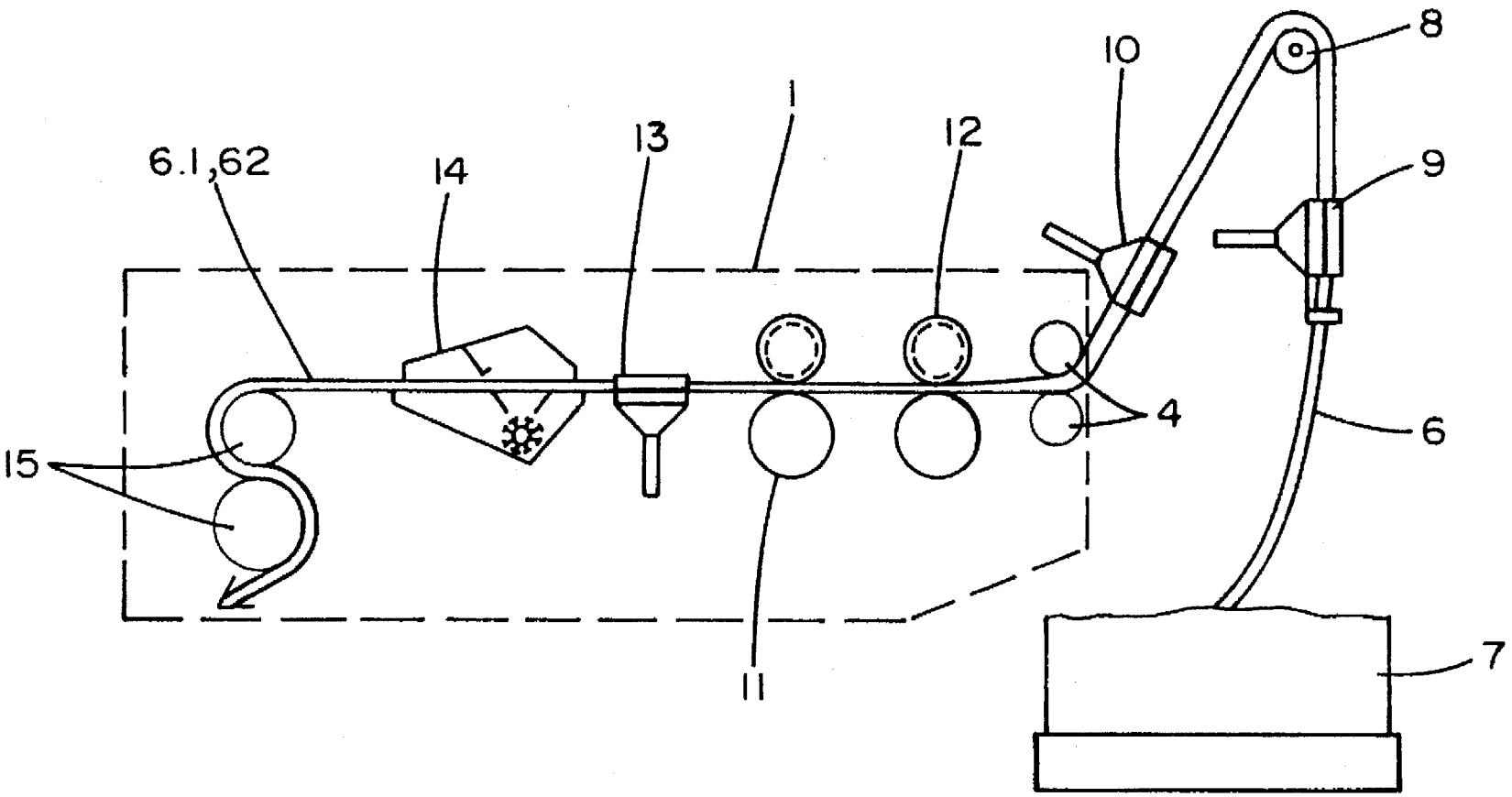
FIG. 3 is schematic side view of the treatment unit in the apparatus of FIG. 1, but without separating device.

Treatment unit 1 comprises a brake system 4, a pair of driven stretch rolls 12, a second pair of driven stretch rolls 11, a spreader nozzle 13, a spray box 14, and a pair of deflecting rolls 15 (FIG. 3).

Figure 2:
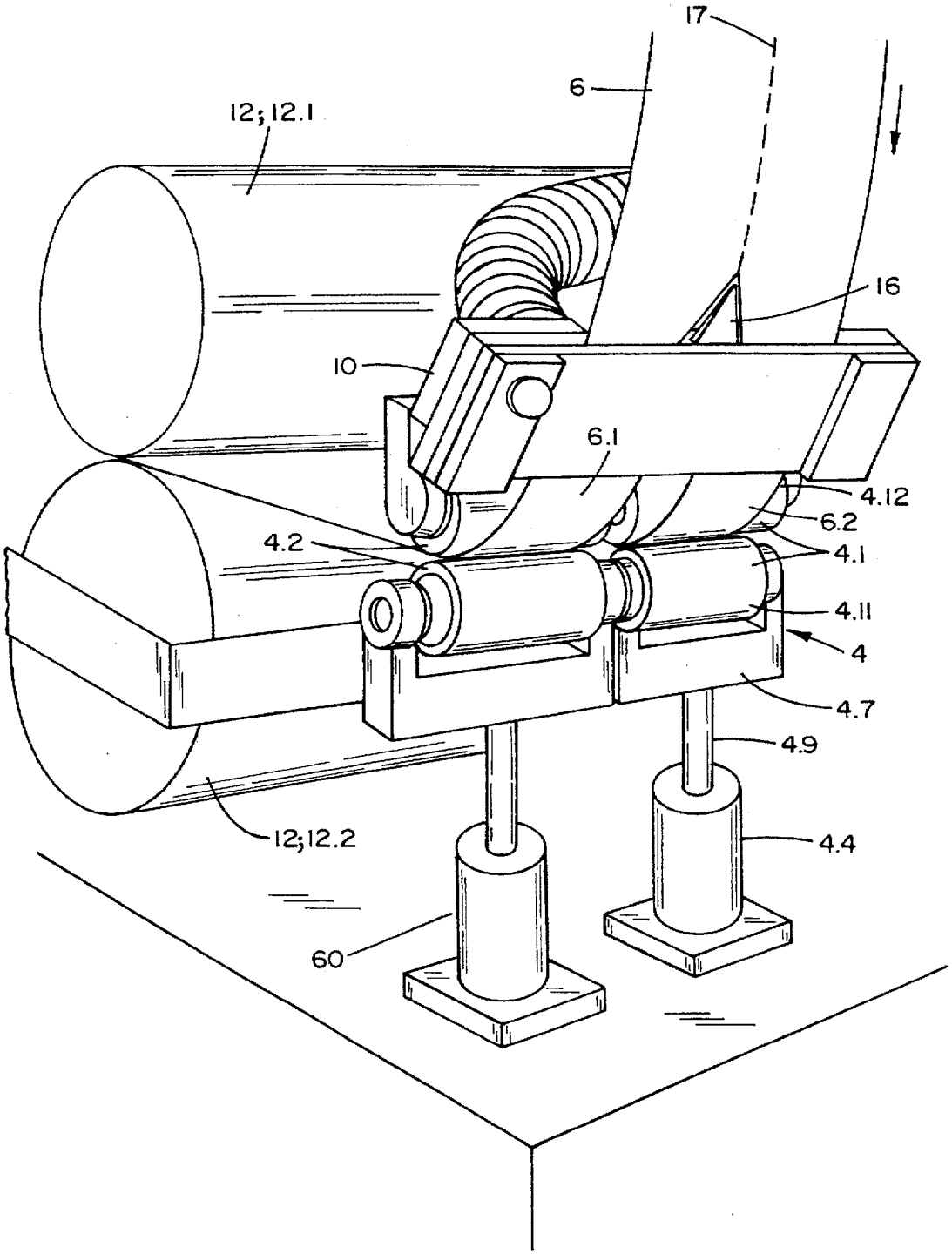
FIG. 2 is a detail view of the treatment unit used in the embodiment according to FIG. 1, with a coupled double pair of brake rolls and a separating device for a supplied double-width divisible filter tow strip.

According to FIG. 2, the brake system 4 of treatment unit 1 comprises two pairs of brake rolls 4.1 and 4.2 arranged side by side and a setting device 60 composed of two pneumatic cylinder-piston units, each comprising a cylinder 4.4 and an associated piston 4.9. At the free end of piston 4.9 a U-shaped support part 4.7 is fastened, in which is mounted a correlated brake roll 4.11 of the pair of brake rolls 4.1. By actuation with compressed air the pneumatic cylinder-piston unit can press the roll 4.11 mounted in the U-shaped support 4.7 upward against a second roll 4.12 of the pair of brake rolls 4.1, to adjust the brake force on the filter tow strip running between the rolls of the pair of brake rolls. In the present form of realization, the two pairs of brake rolls 4.1 and 4.2 are "coupled", i.e. their correlated setting units are pressurized with the same compressed air (the respective compressed air lines and the pneumatic system necessary therefor are known and need not be represented further), in order that the same brake force acts on the filter tow strips at both pairs of brake rolls 4.1 and 4.2.

The two single-width filter tow strips 6.1 and 6.2 are obtained by means of a separating device 16, which may be designed e.g. as a parting wedge or parting plate and which is arranged outside the pairs of brake rolls, by separating a double-width divisible filter tow strip 6. Strip 6 is drawn off continuously from a bale 7 by the first pair of stretch rolls 12 of treatment unit 1, the double-width filter tow strip being guided after removal from bale 7 on its way to the pair of stretch rolls 12 over a deflection roller 8 and passing two air nozzles 9 and 10 which serve to spread and loosen the double-width filter tow strip. Lastly, after the parting device 16, the single-width filter tow strips 6.1 and 6.2 pass through the pairs of brake rolls 4.1 and 4.2, in order to reach the pair of stretch rolls 12. After passing the pair of stretch rolls 12, the two single-width filter tow strips 6.1 and 6.2 get to the second pair of stretch rolls 11 of treatment unit 1, the two filter tow strips being stretched between the two pairs of stretch rolls 12 and 11, this being brought about by the setting of a differential speed between the driven pairs of stretch rolls. After the second pair of stretch rolls 11, the single-width filter tow strips 6.1 and 6.2 are supplied to a dual spreader nozzle 13, where they are spread uniformly for subsequent treatment in spray box 14. In spray box 14 the two filter tow strips 6.1 and 6.2 are provided with a softener, e.g. triacetin, and are then supplied to a pair of deflection rolls 15. The two pairs of stretch rolls 11 and 12 and the pair of deflection rolls 15 are driven, whereas the two pairs of brake rolls 4.1 and 4.2 of the brake unit 4 in the treatment unit 1 are not driven.

The pairs of stretch rolls 11 and 12 together with the devices 13, 14 and 15 form a single stretch mechanism which in processing the double-width filter tow strip or respectively in the simultaneous treatment of the two single-width filter tow strips can be kept essentially without any major modification and need not be provided in duplicate.

The two filter tow strips 6.1 and 6.2 go to the dual inlet funnels 19 of the formating unit 3, where the two single-width filter tow strips are collected to a filter skein and are provided onto a wrapping strip 23 drawn from bobbins 21 and provided with glue by means of a gluing device 22. The wrapping material strip 23 and the respective filter skein pass onto a format band 24 of the formating unit 3, which has two formating belts running parallel. Each of the two formating belts leads the components lying on it through a format 26, which is designed as double format and which places the respective wrapping material strip 23 around the associated filter skein, whereby wrapped filter skeins 27.1 and 27.2 are formed. The wrapped filter skeins thus produced, running side by side, pass through a double seam plate 28, in which the glue seams of the wrapped filter skeins 27.1 and 27.1 running side by side are sealed. Thereafter the parallelly running filter skeins are cut by a cutter 29 continuously into filter rods 31 running side by side, which are transferred into one of two deposit drums 12, in which they are deflected in a cross-axial transport direction, where they are transferred via one of two test drums 33 onto a delivery belt 34, whence they are sent to further processing or intermediate storage.

The filter-making machine has a measuring device 46 known per se, with which a characteristic value of the filter skeins 27.1 and 27.2, here the density or mass of the filter skeins, is determined. The measuring device 46 is connected with a control system 48 which furnishes the mass data as signal. As measuring device 46 may be used e.g. a radioactive radiation source (beta ray tube). This measuring device is described in detail in DE OS 2208944, to which reference is here expressly made in this respect.

Optionally the measuring device may comprise an additional measuring means known per se for determining a second characteristic value of the filter skeins, namely the draw resistances of the severed filter rods 31 and hence of the filter skeins 27.1 and 27.2. For this purpose a test drum 33 is used, with which the draw resistance of the filter rods of the individual filter skeins 27.1, 27.2 is measured. Measurement of the draw resistance of filter rods with a test drum is known per se. In this connection reference is made for example to DE 4109603 A1. A more detailed elucidation of the test drum and of the respective measuring process is therefore not made here. Test drum 33 is connected with the control system 48, which as a function of the draw resistance data and mass data generates control signals by which the two pairs of brake rolls 4.1, 4.2 of brake unit 4 are actuated for setting the brake force, to adjust the quantity to be processed of the single-width fiber strips 6.1, 6.2. Instead of the double test drum 33, a measuring means 49 may be provided for the draw resistance measurement for determining the draw resistance of the individual filter skeins. Such a measuring means is referred to e.g. in DE 4109603 A1. The draw resistance measurements just mentioned can be used in addition to the density measurement or as an alternative measurement and are therefore shown in FIG. 1 in broken lines with respect to their output signals.

As measuring means 46 for the density of the finished filter skeins a double measuring head may be provided which operates with a radiation which penetrates the fiber skeins. The double measuring head may use for example beta radiation.

In the following it is to be assumed that only the density or mass of the produced filter skeins 27.1 and 27.2 is picked up and determined by the measuring device 46, and by the control device 48—which may comprise e.g. a microprocessor or micro-computer with ROM, RAM, CPU and respective input/output units—only the density signal associated with the weight of the filter skeins is evaluated for actuating the brake unit 4 in the treatment unit 1.

Figure 4:
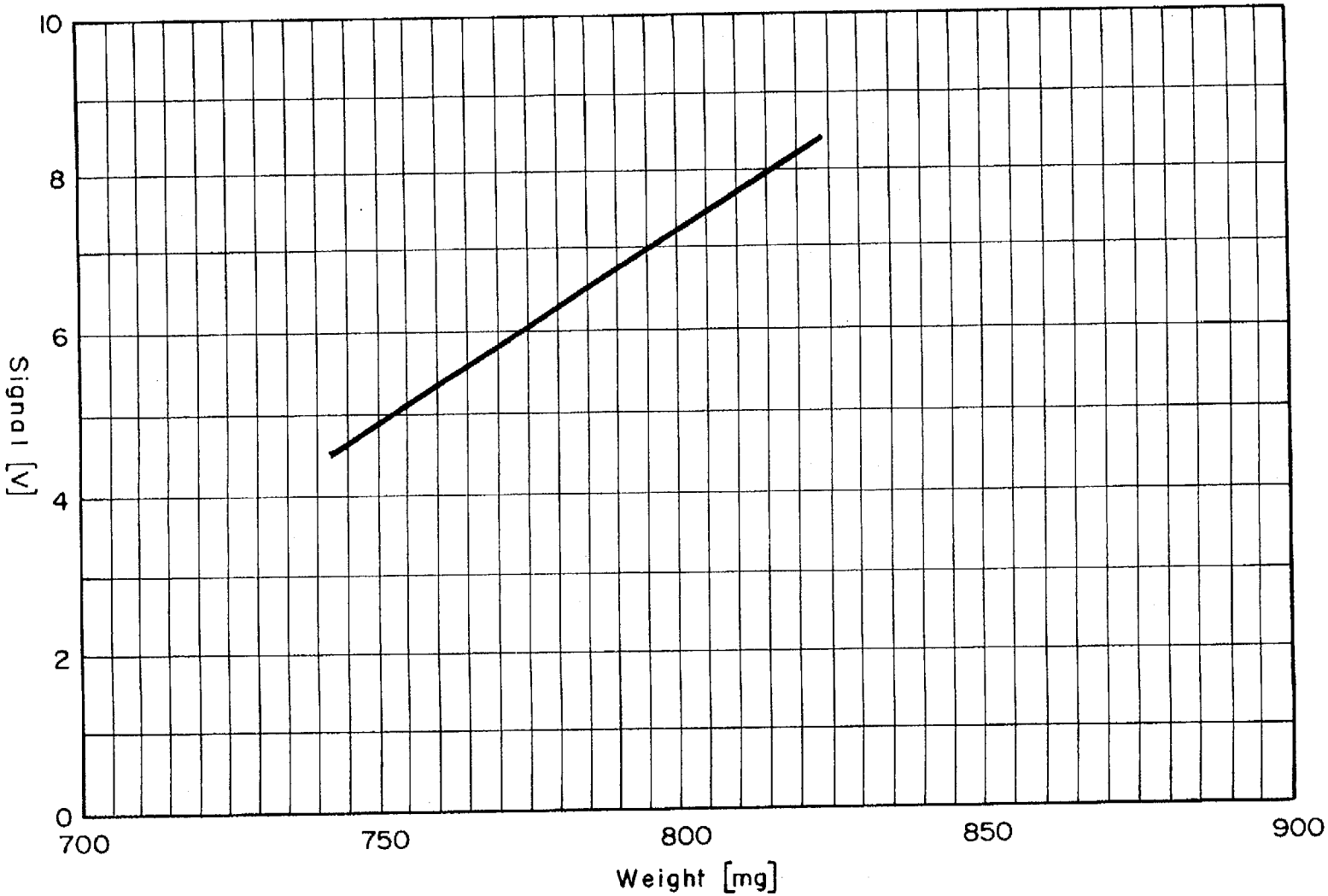
FIG. 4 is a function diagram showing a generated signal as a function of the weight of a filter skein.
Figure 5:
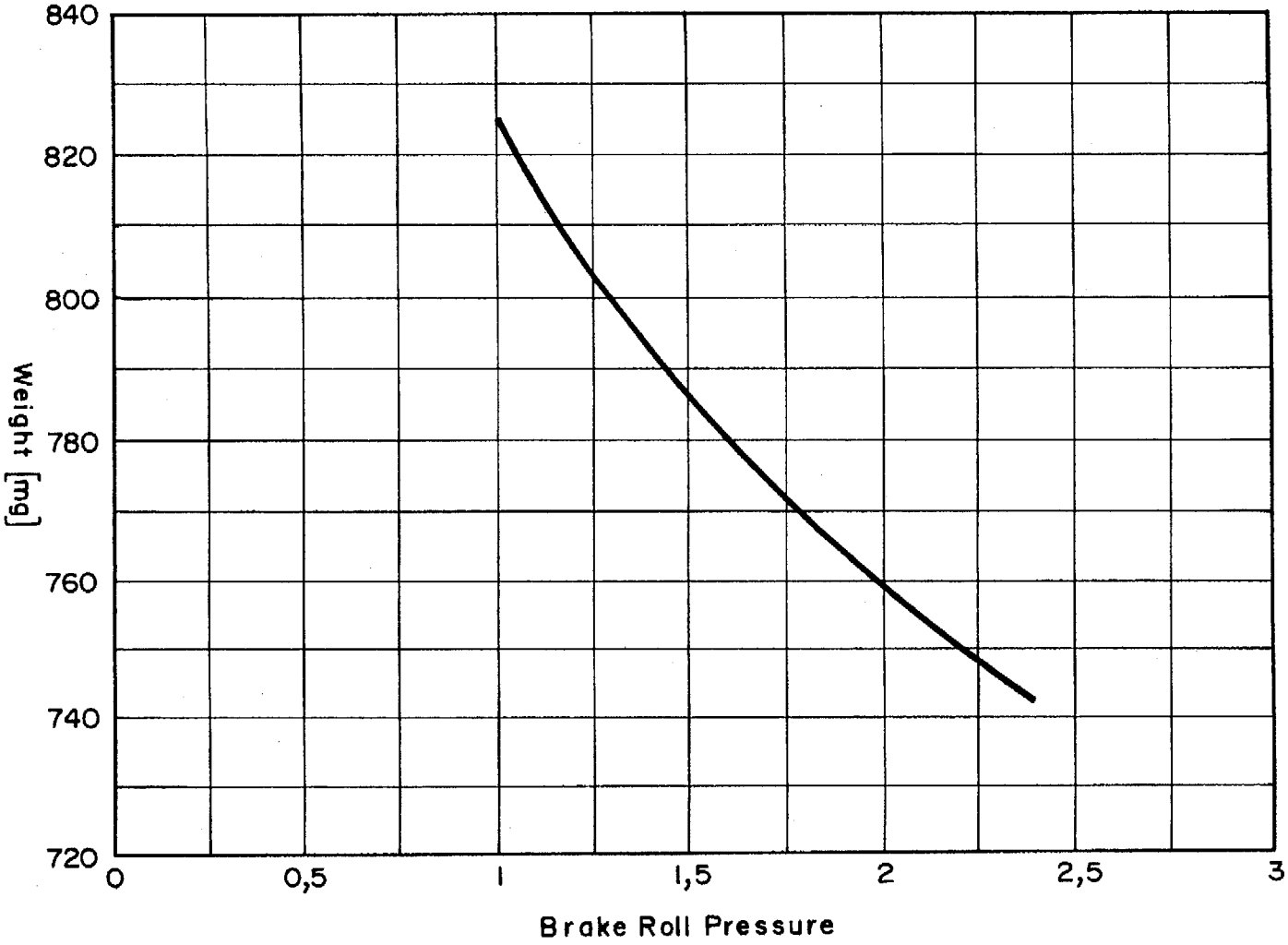
FIG. 5 is a function diagram showing the dependence of the weight of the filter skein on the brake force (brake roll pressure) applied by a brake unit in the apparatus of FIG. 1.

FIG. 4 shows the functional relationship between the mass of the filter skeins 27.1, 27.2 and the output signal of the measuring device 46. As can be seen from FIG. 4, there is a linear relationship between the found mass and the density signal. The control device 48 evaluates the arriving density signals for the two filter skeins 27.1 and 27.2, forms a mean of the signals, and compares this actual value to a stored desired value SOLL for the density of the filter skeins. If the comparison shows that the actual mass of the filter skeins 27.1 and 27.2 is lower than the desired value SOLL, the control device 48 furnishes an electric control signal to the setting device in the brake unit 4, which transforms this control signal into a corresponding stroke of the cylinder-piston units of the setting device 60, that is, in this case the pistons of the pneumatic setting units are taken back a little to lower the brake force, in order to increase the quantity to be processed of the filter tow strips 6.1 and 6.2. If the comparison in the microcomputer-controlled control unit 48 shows that the found mass of the two filter skeins 27.1 and 27.2 is grater than the desired value SOLL; the control unit 48 generates a corresponding control signal which causes the pneumatic setting units in the brake unit 4 to increase the brake force on the two fiber strips 6.1 and 6.2 between the two pairs of brake rolls 4.1 and 4.2 in order to reduce the supplied quantities of the two fiber strips 6.1 and 6.2. The control unit 48 determines the respective control signal e.g. on the basis of a stored characteristic representing the relationship between the mass of the produced filter skeins 27.1, 27.2 or the found mean value for these filter skeins and the brake roll pressure or brake force. A typical characteristic curve for this relationship can be seen in the function diagram of FIG. 5.

Figure 6:
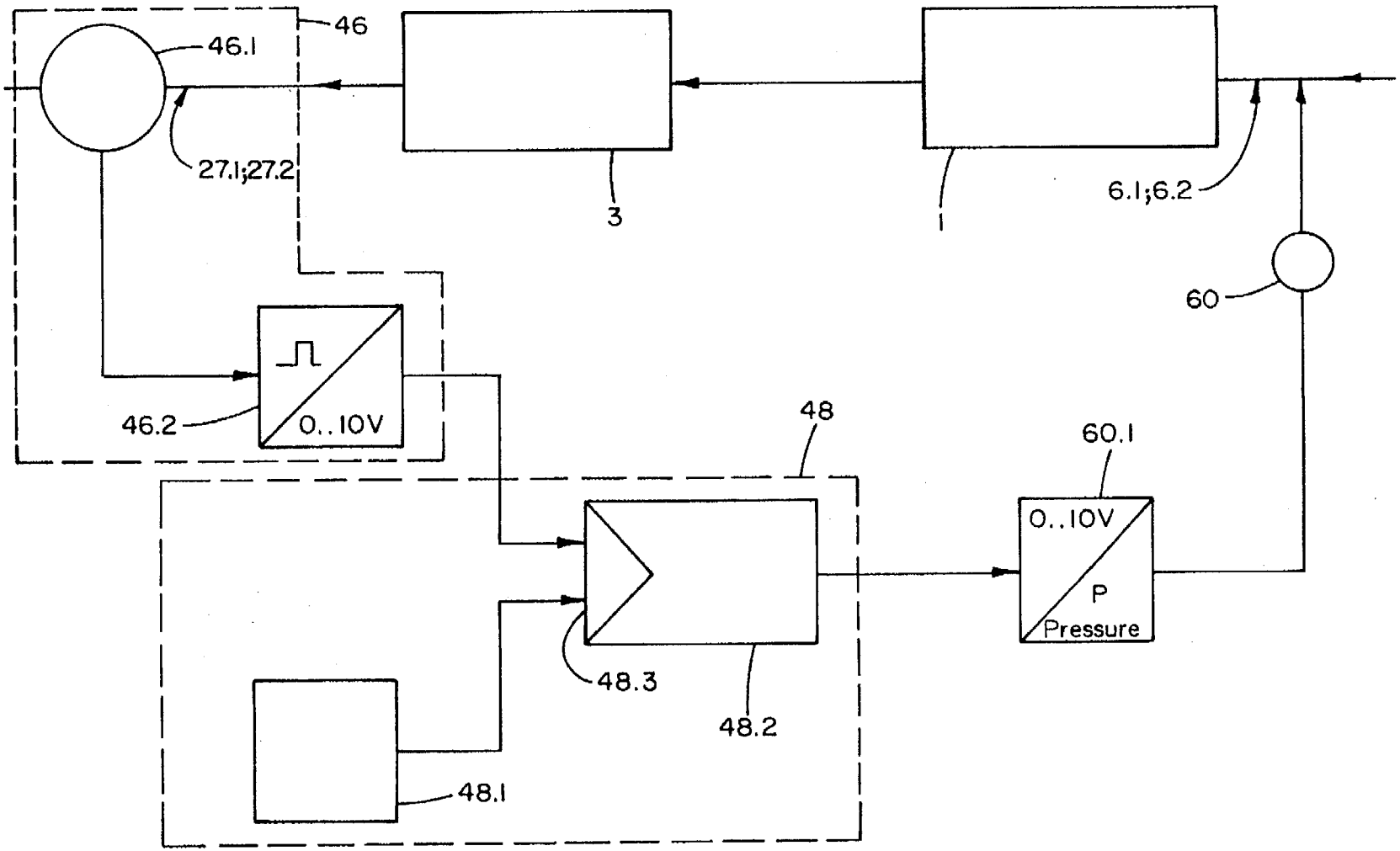
FIG. 6 is a block diagram showing the essential devices of a control circuit for regulating the supply quantity of filter tow strip via the brake force on the filter tow strip.

To clarify the above described controlling and regulating sequences, FIG. 6 represents a control circuit in a block diagram showing the essential devices participating in the control.

The filter skeins 27.1 and 27.2 simultaneously produced by the formating unit 3 and running side by side are scanned by means of a double measuring head 46.1 of the measuring device 46, to pick up the density or mass of the filter skeins 27.1 and 27.2. The double measuring head furnishes a frequency-modulated signal, which is converted by a frequency/voltage converter into an electric signal. The electric signal is compared with the desired value SOLL delivered by a setpoint transmitter 48.1. The comparator 48.3 delivers the comparison result to a regulator 48.2, which generates the above-mentioned electric control signal. As regulator 48.2 may be used e.g. a conventional PID controller or, as mentioned before, a microprocessor or microcomputer, which then assumes, besides the regulator function, also the comparison function of the comparator 48.3 and the function of setpoint transmitter 48.1. The devices 48.1, 48.2 and 48.3 are contained in the control unit 48. The electric control signal is delivered via respective lines or cabling to a voltage/pressure converter 60.1, which converts the supplied electric control signal to a corresponding pressure signal or respectively to a pressure for actuating the pneumatic setting unit(s) in the setting device 60, to set the brake force on the supplied filter two strips 6.1 and 6.2 before the filter tow strips are guided to the next treatment unit 1 and then to the formating unit 3. The object of the control is to adjust the feed quantity of filter tow strips 6.1 and 6.2 to a constant value, which is given by the desired value SOLL generated by the setpoint transmitter 48.1 of the control unit 48.

Figure 7:
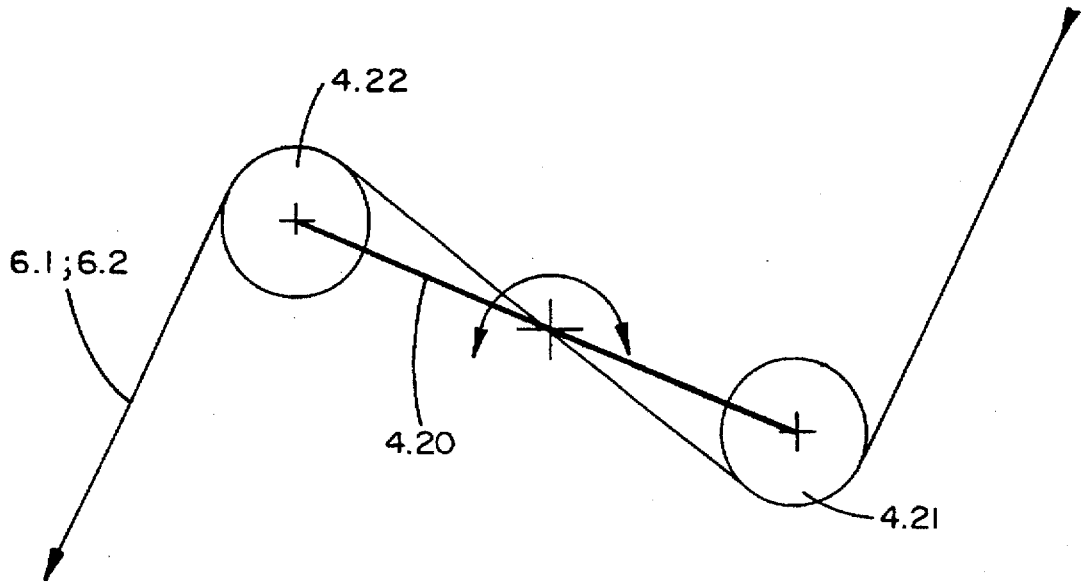
FIG. 7 is a schematic side view of a brake system for use in the form of FIG. 1, the brake system using brake rods instead of brake rolls.

As an alternative to the embodiment of FIG. 1, the brake unit 4 may have as alternative means brake rods 4.22 and 4.21, shown schematically in FIG. 7 in side view. Between the brake rods 4.21 and 4.22, a holder 4.20 is arranged, at the ends of which the brake rods 4.22 and 4.21 are fastened. Holder 4.20 is rotatable about an axis extending parallel to the axes of the brake rods 4.22 and 4.21. In FIG. 7 a direction of rotation of holder 4.20 is indicated by the curved double arrow. Consequently, upon rotation, and to the axes of the brake rods 4.21 and 4.22. As drive for the rotatable holder 4.20 of the present rod brake of FIG. 7 and electric, pneumatic, or hydraulic drive mechanism may be used. By rotation of the holder, the position of the brake rods 4.22 and 4.21 is changed, so that also the looping angle of the filter tow strips on the brake rods changes, which are guided over the brake rods, as shown in FIG. 7, and accordingly a different brake force acts on the filter tow strips. Thereby the brake force can be varied via a correspondingly designed setting device 60 by means of the brake unit according to FIG. 7.

Figure 8:
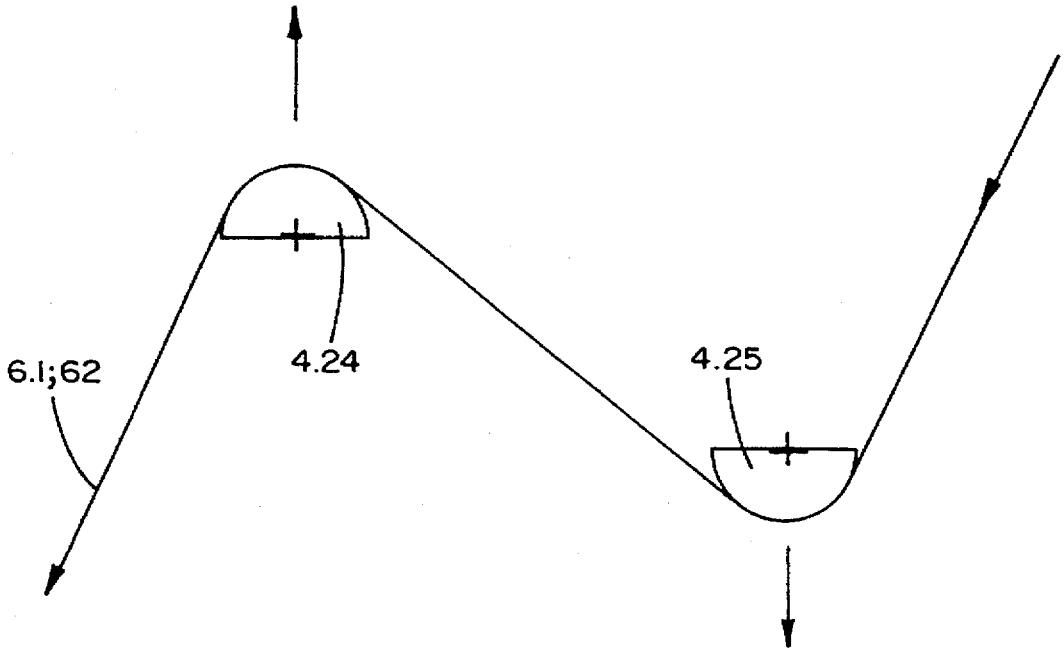
FIG. 8 is a schematic side view of another alternative brake system which can be used in the embodiment of the present invention of FIG. 1, the alternative brake system using brake plates instead of brake rolls.
Figure 9:
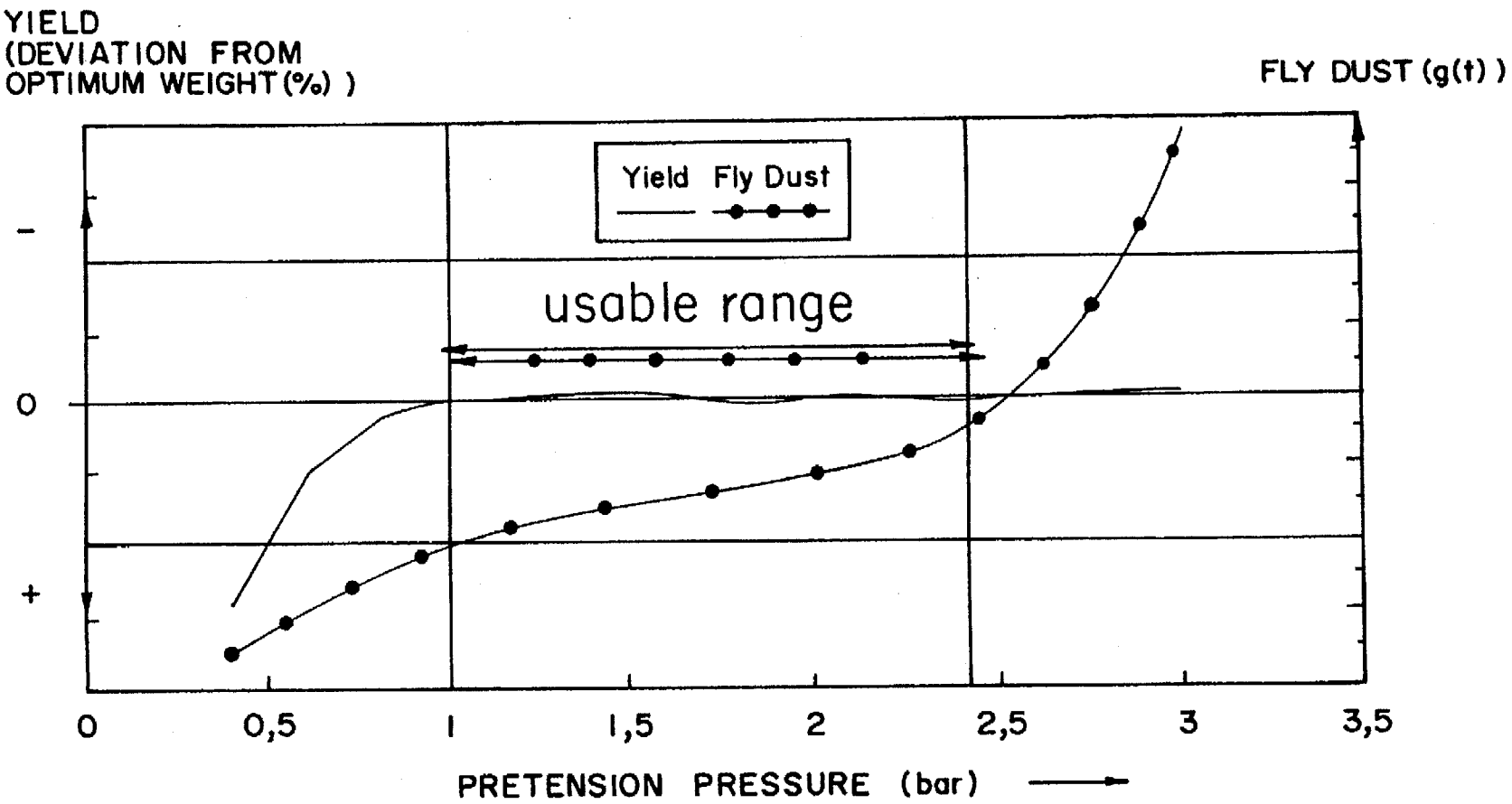
FIG. 9 is a diagram showing the relation of yield (deviation from optimum weight (%)) and the relation of fly dust via the pretension pressure in the case of the invention.

In FIG. 8 is shown another alternative design of the brake unit 4 in the embodiment of the invention of FIG. 1. Here two brake plates 4.24 and 4.25 of semicircular cross-section are used as brake unit 4. The two brake plates 4.24 and 4.25 are arranged offset in spaced relation to each other and displaceable in opposite direction through a drive mechanism not shown, the directions of movement of the brake places 4.24 and 4.25 being indicated in FIG. 8 by arrows. The filter tow strips 6.1 and 6.2 are guided around the brake plates 4.25 and 4.24 in this sequence in running direction of the filter tow strips 6.1 and 6.2. With decreasing distance between the two brake plates 4.24 and 4.25 in the direction of the movement arrows of the brake plates shown in FIG. 8, the looping angle of the filter tow strips 6.1 and 6.2 around the brake plates 4.24 and 4.25 decreases, and the lower will be the brake force acting on the filter tow strips 6.1 and 6.2. Thus also in the embodiment of the brake unit 4 of FIG. 8 the brake force on the fiber strips can be varied through an appropriate setting device 60.

The first driven pair of stretch rolls 12 comprises a first roll 12.1 and a second roll 12.2 as shown in FIG. 3. The second driven pair of stretch rolls 11 comprises a first roll 11.1 and a second roll 11.2. The second roll 12.2 of the first driven pair of stretch rolls 12 is profiled over its entire surface and the rolls 12.1, 11.1 and 12.2 have a smooth surface. In alternative the second roll 11.2 of the second driven pair of stretch rolls 11 is profiled over its entire surface and the other rolls 11.1, 12.1 and 12.2 have a smooth surface. In further alternative, each of the rolls 11.2 and 12.2 is profiled over its entire surface, and the other rolls 11.1 and 12.1 have a smooth surface. In yet a further alternative the rolls 11.1 and 12.1 are profiled over their entire surface, and the rolls 11.2 and 12.2 are smooth. In FIG. 11, there are shown by way of example four different profiles (a), (b), (c) and (d) of the roll 11.1 and/or the roll 12.1.

FIG. 11(*a*) shows a threaded profile comprising a pitch x/y=0.43 mm/1.81 mm resulting in ca. 25% of contact surface. The end surfaces ES of the thread are flat and not round or curved in order to attain an accurate degree of contact surface between the rolls of the respective pair of rolls. The grooves of the thread have a triangular shape.

FIG. 11(*b*) shows a further threaded profile comprising pitch x/y=0.9 mm/1.81 mm resulting in ca. 50% of contact surface. The end surfaces of this thread are flat. The grooves of this thread have a triangular shape with a more rounded bottom than in the case of the thread of FIG. 11(*a*).

FIG. 11(*c*) shows a further profile with a rib/groove structure that has a pitch x/y=0.7 mm/1.4 mm resulting in ca. 50% of contact surface. The end surfaces of the ribs are flat. The grooves have a rectangular shape with a bottom of circular shape. The depth of the grooves is 2.0 mm.

FIG. 11(*d*) shows a forth example of profile in the form of a thread that comprises a pitch x/y=0.38 mm/1.25 mm resulting in ca. 30% of contact surface. The end surfaces of the thread are flat. The grooves of the thread have a triangular shape and the depth of the grooves is 0.93 mm.

We claim:

1. A method of producing at least one filter skein for cigarettes and other smokable rod-shaped articles, from at least one filter tow strip which comprises the steps of:

(a) drawing said at least one filter tow strip, from at least one supply, (b) feeding said at least one filter tow strip to a treatment in a treatment unit;

(b1) at the beginning of said treatment unit, subjecting said at least one filter tow strip to a brake force to adjust at least the quantity to be processed, the brake force being set automatically, and (b2) afterwards, inter alia, stretching and fluffing of said filter tow strip(s) by the use of two pairs of rolls, wherein the surface of one roll of at least one pair of said two pairs is smooth and the other roll is profiled over its entire surface, (c) after said treatment, collecting said treated filter tow strip from step (b) in a formating unit to at least one round filter skein and providing said at least one round skein with an enveloping material to form at least one continuous, wrapped filter skein, (d) detecting and measuring a characteristic value of said produced filter skein from step c), to obtain an actual value of said characteristic value, and (e) controlling and regulating said brake force as a function of said obtained actual value from step (d) and of a predetermined desired value of said characteristic value at the beginning of said treatment in step (b1), prior to said stretching step (b2), the brake force acting on said at least one filter tow strip.

2. The method according to claim 1, wherein during said drawing step (a) a multiple width, divisible filter tow strip is drawn from said supply as the only fiber strip.

3. The method according to claim 2, wherein said multiple width filter tow strip is subdivided into several single strips prior to subjecting each single strip to an identical brake force in step (b1).

4. The method according to claim 1, wherein during said drawing step (a) a double-width, divisible filter tow strip is drawn, from which two filter skeins are produced.

5. The method according to claim 1, wherein during said drawing step (a) a multiple width or a double-width filter tow strip is drawn from the supply, said filter tow strip is provided with at least one tear line for separating said filter tow strip, and said filter tow strip is parted at at least one said tear line for providing single-width single strips made of filter tow, said single strips being separated from each other prior to said step (b1).

6. The method according to claim 1, wherein during said detecting and measuring step (d) at least one characteristic value for each of the simultaneously produced filter skeins is detected and measured, and the method comprises the steps of determining from the results of the measurement and preset nominal values a mean for the brake force, and subjecting each of said strips supplied to said treatment to the same mean brake force.

7. The method according to claim 1, wherein during said drawing step (a) two filter tow strips are drawn simultaneously from separate supply bales, and the method produces simultaneously two filter skeins.

8. The method according to claim 7, wherein during the detecting and measuring step a characteristic value is detected and measured for each of said filter skeins, and results are obtained and during the controlling or regulating step on the basis of said results the quantity to be processed of each of said filter tow strips is adjusted by regulating the brake force acting on each of said filter tow strips.

9. The method according to claim 1, wherein a single filter skein is produced from a single filter tow strip drawn during said drawing step, and during said detecting and measuring step a characteristic value of said filter skein is detected and measured, and results are obtained and during said controlling or regulating step the quantity to be processed of the filter tow strip is controlled or regulated as a function of said results and on the basis of predetermined values by regulating the brake force on the filter tow strip.

10. The method according to claim 1, wherein during said detecting and measuring step a density or mass of said produced filter skein is determined as characteristic value.

11. The method according to claim 1, wherein during said detecting and measuring step the draw resistance of said filter skein is determined as characteristic value.

12. The method according to claim 1 wherein short term variations of the mass at an optimum yield of the filter skein(s) are reduced or eliminated in addition to long term variations.

13. An apparatus for producing at least one filter skein for cigarettes and for other smokable rod-shaped articles, from at least one filter tow strip which comprises:

(a) feeding means for continuous feeding at least one filter tow strip to a treatment unit, (b) said treatment unit having an inlet side and comprising, (b1) a brake unit arranged on said inlet side in said treatment unit, said brake unit exerting a brake force on said at least one filter tow strip, to adjust the quantity to be processed of said at least one filter tow strip to a predetermined value, (b2) stretching means arranged downstream of said brake unit providing stretching of said at one filter two strip, and, (b3) fluffing means arranged downstream of said stretching means providing fluffing of said at least one stretched filter tow strip, wherein the stretching and fluffing means comprise two pairs of rolls, wherein the surface of one roll of at least one pair of said two pairs is smooth and the other roll is profiled over its entire surface, (c) a formating unit for forming at least one filter skein from at least one filter tow strip, treated in treatment unit (b), (d) a measuring device for detecting and measuring at least one characteristic value of said at least one filter skein, to provide respective measurement signals which are assigned to an actual value of the characteristic value, (e) means for providing said actual value of the charateristic value from said measurement signals, for comparing said actual value with a predetermined desired value and for providing an electrical control signal, and (f) a setting device for controlling said brake unit depending on said electrical signal from said means (e), to control or regulate automatically said quantity of said at least one filter tow strip, to be processed by means of said exerted brake force.

14. The apparatus according to claim 13, wherein said filter tow strip is a multiple width, pre-separated, divisible filter tow strip.

15. The apparatus according to claim 14, wherein upstream of said treatment unit a separating device is provided which parts said multiple width filter tow strip into single strips.

16. The apparatus according to claim 15, wherein said separating device parts said multiple width filter tow strip at a tear line of the filter tow strip, whereby said filter tow strip is separated into single-width single strips.

17. The apparatus according to claim 13, wherein said measuring device determines the characteristic value for said at least one filter skein and delivers respective measurement signals to said setting device, said setting device actuates the brake unit in such a way that the quantity to be processed of said single-width filter tow strip is adjusted automatically.

18. The apparatus according to claim 13, wherein said brake unit has several non-driven mutually separated pairs of brake rolls through which runs a filter tow strip, and said pairs of brake rolls exert a brake force on the filter tow strip passing through them, the brake force being adjustable.

19. The apparatus according to claim 13, wherein the brake unit has two pairs of brake rolls.

20. The apparatus according to claim 19, wherein said two pairs of brake rolls are coupled and exert an identical brake force.

21. The apparatus according to claim 13, wherein said brake unit comprises a multiple width, double-width, or single-width non-driven pair of brake rolls.

22. The apparatus according to claim 13, wherein said brake unit comprises a non-driven pair of brake rolls, and said at least one filter tow strip runs there through.

23. The apparatus according to claim 13, wherein said brake unit comprises two brake rods, said at least one filter tow strip is guided over said brake rods, at least one of said brake rods is movable, whereby the position of the brake rods relative to each other can be changed, to be able to adjust the brake force on said at least one filter tow strip.

24. The apparatus according to claim 13, wherein said brake unit has at least one brake plate, said at least one filter tow strip is guided over said brake plate, and the brake plate is movable, to be able to adjust or change the brake force on said at least one filter tow strip.

25. The apparatus according to claim 13, wherein said measuring device determines as characteristic value the draw resistance of said at least one filter skein.

26. The apparatus according to claim 13, wherein said measuring device determines as characteristic value the density or mass of said at least one filter skein produced by said formating unit.

27. The apparatus according to claim 13 wherein short term variations of the mass at an optimum yield of the filter skein(s) are reduced or eliminated in addition to long term variations.

* * * * *